US006556111B2

(12) United States Patent
Felden et al.

(10) Patent No.: US 6,556,111 B2
(45) Date of Patent: Apr. 29, 2003

(54) SELECTIVE RELEASE UNIT FOR CIRCUIT BREAKER

(75) Inventors: Walter Felden, Neumunster (DE); Eladia Pulido, Barcelona (ES)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,322

(22) Filed: Mar. 16, 2001

(65) Prior Publication Data

US 2002/0047762 A1 Apr. 25, 2002

(51) Int. Cl.[7] ..... H01H 9/00
(52) U.S. Cl. ..... 335/172; 335/35; 335/38; 335/42; 335/176
(58) Field of Search ..... 335/35–45, 167–176

(56) References Cited

U.S. PATENT DOCUMENTS 3,264,435 A * 8/1966 Klein et al. ..... 335/35
3,849,751 A * 11/1974 Link et al. ..... 337/58
5,225,800 A * 7/1993 Pannenborg et al. ..... 335/35
5,831,499 A * 11/1998 Batteux et al. ..... 335/9

FOREIGN PATENT DOCUMENTS

DE 4005713 * 8/1991

* cited by examiner

*Primary Examiner*—Lincoln Donovan
(74) *Attorney, Agent, or Firm*—Cantor Colburn LLP

(57) ABSTRACT

A release unit for a circuit breaker is equipped with a magnet yoke and an armature collaborating with it for actuating a release device, in which case a nonmagnetic weight element that increases the inertia of the armature is applied to the armature.

14 Claims, 4 Drawing Sheets

SELECTIVE RELEASE UNIT FOR CIRCUIT BREAKER

FIELD OF THE INVENTION

The present invention relates to a selective release unit for a circuit breaker.

BACKGROUND OF THE INVENTION

A release unit with an armature or gate and a yoke is known from the prior art. If the gate is applied, it has to shift the front gate further so that a brief high current does not result in release. The insertion of a magnet flap in a direction leading away from the magnet yoke in order to brake the magnet flap in its closing movement is also known from the prior art. It is thus possible to prevent a release in the case of brief overcurrents.

One disadvantage of prior art solutions is that in circuit breakers switched in series with one large and several small parallel circuit breakers, the disengagement of one of the small circuit breakers could possibly lead to disengagement of the large circuit breakers, such that the entire operation no longer has any current. But only the subordinate breakers should release in the case of a strong overcurrent or short circuit. For example, selectivity should be achieved in circuit breakers up to 10 kA such that no disengagement occurs with a current of 3 kA at 5 msec in large circuit breakers.

A release mechanism for a circuit breaker shown in FIG. 6 is known from the earlier German patent application No. 199 03 911.9. This breaker 1 has a moveable contact 2 that is rotatably supported on the shaft 3 of a selector shaft 4. The selector shaft 4 is itself supported in a polhode housing (not shown) and has two diametrically opposed satellite shafts 5 and 6 that are entrained around the axis 3 with a rotation of the selector shaft 4. The axis 5 is the point of application for an articulation mechanism 7 that is connected with a ratchet lever 8. The ratchet lever is pivotably supported on a shaft 10 positioned on the breaker housing 9 and is released in the case of an overcurrent or short circuit by a breaker latch 11 to enable the separated state of the contact 2 shown in FIG. 6.

The breaker latch 11 can be actuated by a release lever 13 pivotable around a rotation axis 12. The release lever 13, on the other hand, is in working connection with a release shaft 14 that is supported on a shaft 15 carried by the breaker housing 9. A lifter 16 is formed on the release shaft 14, which is pivotable against the force of a spring wound around the shaft 15 (not shown in detail here) in the clockwise direction in FIG. 6.

A magnet yoke 17 is mounted on the breaker housing 9 in the lower section of the circuit breaker and encompasses an electric rail 19 connected with the contacts of the breaker 1. An armature element 21 designed as a flap is located opposite the magnet yoke 17 and it is pivotably connected via a hinge connection 18 with a stationary section of the circuit breaker (not shown in detail). The flap 21 is also connected through a spring 20 with a stationary section of the rail 19, said spring acting on the flap in the clockwise direction. In its upper region, as shown in Figure the flap 21 is equipped with a bracket 23 permanently attached to it which, by a pivoting movement of the flap 21, can be brought into contact with the cam 16 to rotate the release shaft 14, thereby actuating the breaker latch 11 via the release lever 13 and thus initiating the disengagement process in the circuit breaker 1. Reference is made to the description of the above-mentioned German patent application for further details on this prior solution.

SUMMARY OF INVENTION

The purpose of the invention is to make available a selective release unit, which, if incorporated in a large circuit breaker, does not cause release of the latter if release occurs in a subordinate smaller circuit breaker.

BRIEF DESCRIPTION OF DRAWINGS

The invention is explained in the following on the basis of two embodiments, with reference to the drawings.

DETAILED DESCRIPTION

Figure 6:
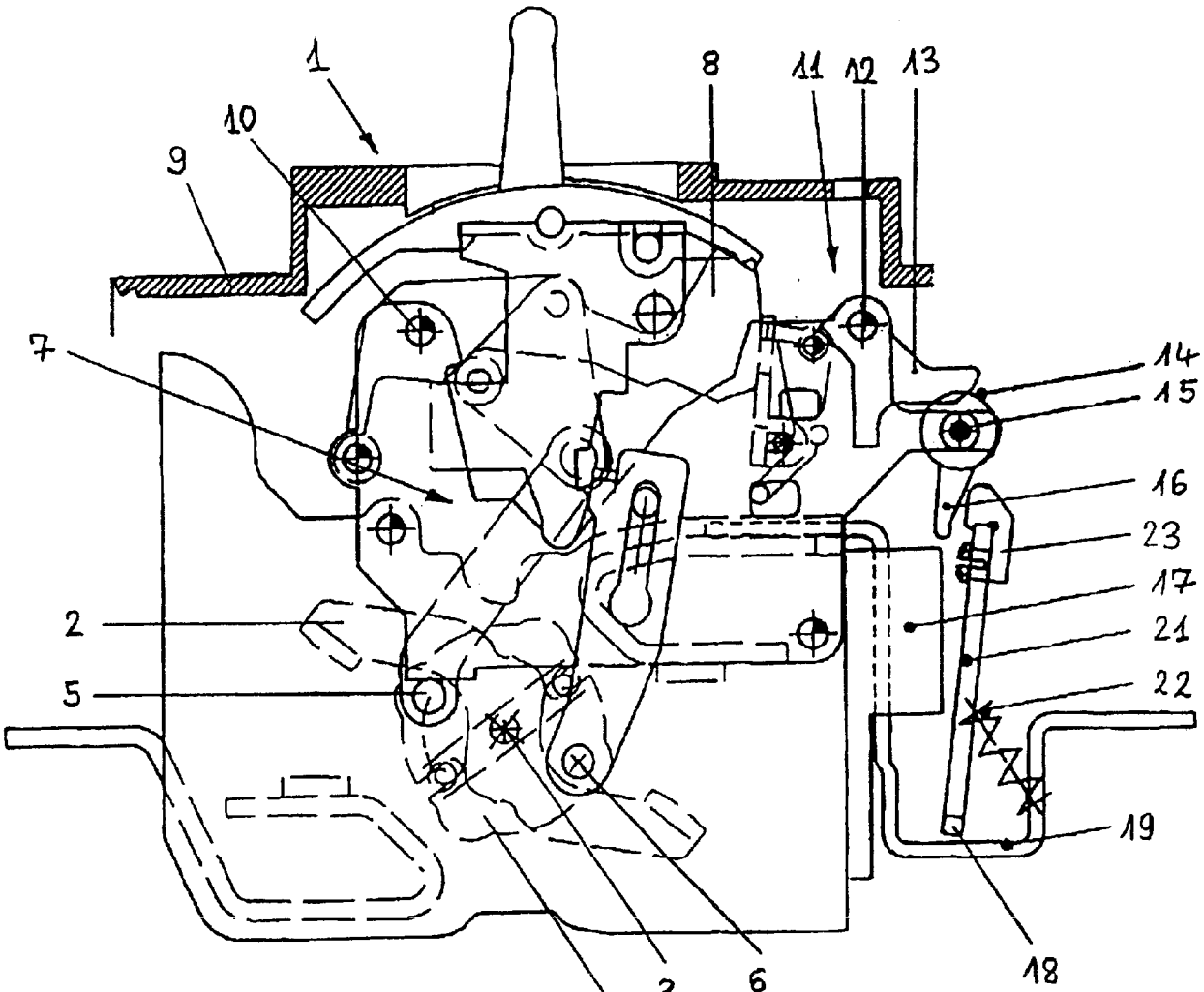
FIG. 6 is a representation of the prior art mechanism of a circuit breaker with a relevant release unit.

According to a first embodiment, the selective release unit has essentially the same construction as in FIG. 6, except that a weight 25 of 3–15 g, preferably 9–11 g, is applied to the flap 21 on the side of the flap facing away from the magnet yoke 17. As a result of this measure, the inertia of the flap is increased sufficiently to prevent the flap from closing immediately after a short circuit. It is obvious here that the size of the weight is designed by taking into account the characteristics of the spring shown in FIG. 2 and the other characteristics of the breaker system so that no release is induced if a release occurs in a subordinate smaller circuit breaker. This embodiment involves a circuit breaker with a nominal current of 125 A, in which an overcurrent 50 times the nominal current develops within 1 msec.

Figure 1:
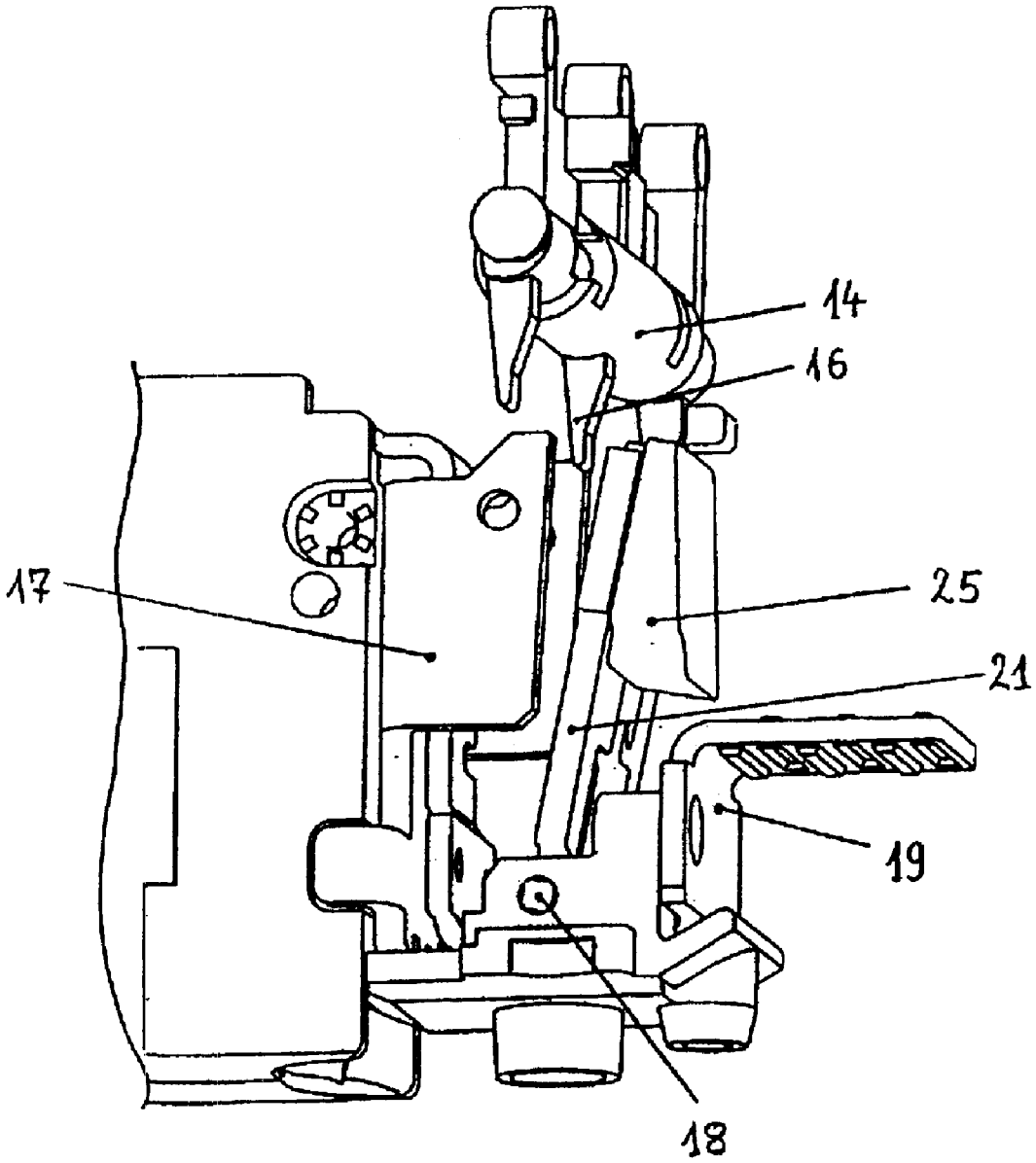
FIG. 1 is a perspective view of a selective release unit.
Figure 2:
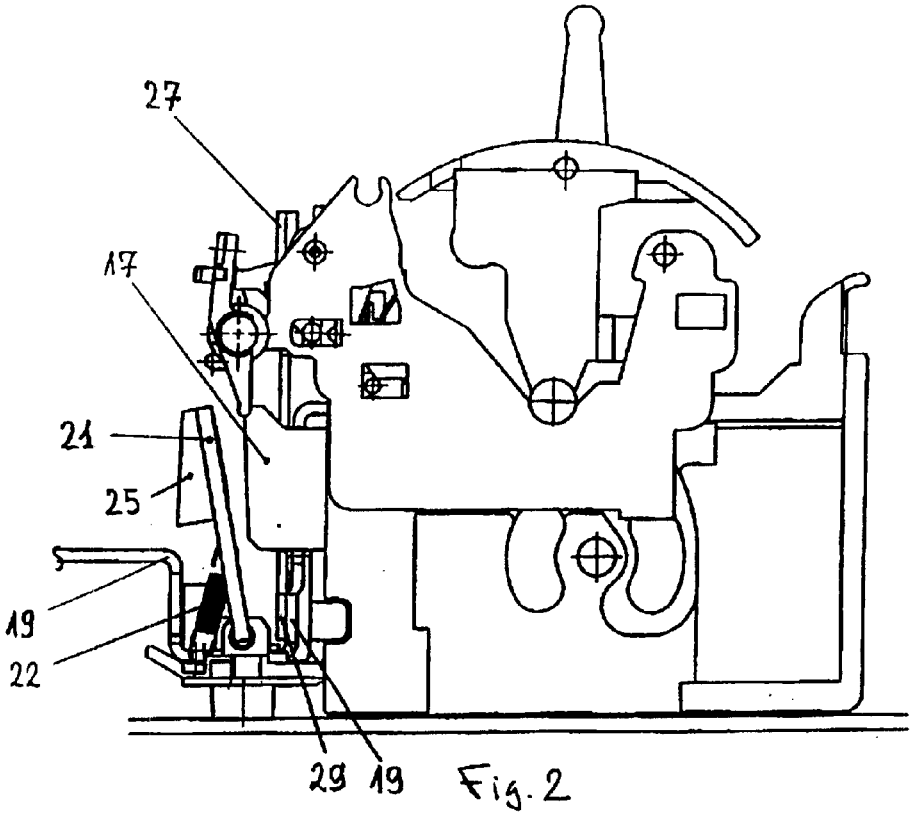
FIG. 2 is a front view of a circuit breaker equipped with the release unit shown in FIG. 1.

As shown in FIG. 2, bimetallic plate 27 (not shown in detail in FIG. 1) is applied in the U-shaped magnet yoke 17 and is located with its lower section 29 on the rail 19. Along the remaining section, the bimetallic plate 27 is separated by an air gap from the rail 19 running upward in FIG. 2.

Figure 3:
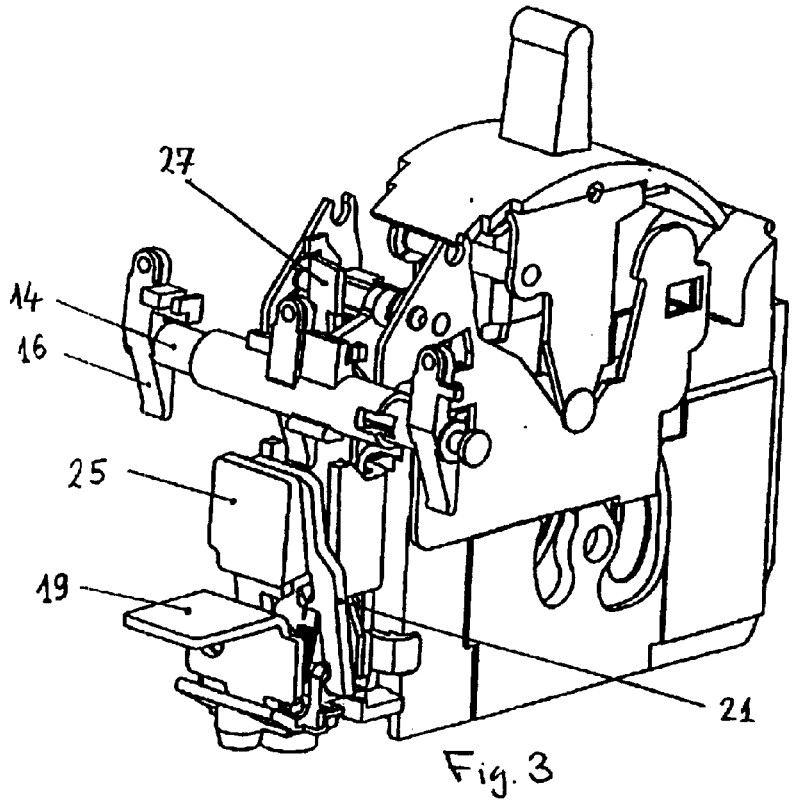
FIG. 3 is a perspective view of the circuit breaker shown in FIG. 2.

The release unit described above functions as follows: If the current flowing through the rail 19 exceeds a nominal current by 5–30%, heating of the bimetallic plate 27 occurs such that the upper section of the bimetallic plate effects actuation of the breaker latch 11 and produces a release movement. In the case of a short circuit current exceeding an overcurrent, the flap 21 is drawn to the magnet yoke 17, while a current strength sufficient to release a subordinate circuit breaker draws the flap 21 provided with the weight element 25 to the magnet yoke 17 only to a certain degree, under the additional braking action of the spring 22. During this last process, release is not yet reached, which assures selectivity with regard to the subordinate breakers. The spatial arrangement of the above components of the release unit is evident from the representation in FIG. 3.

Figure 4:
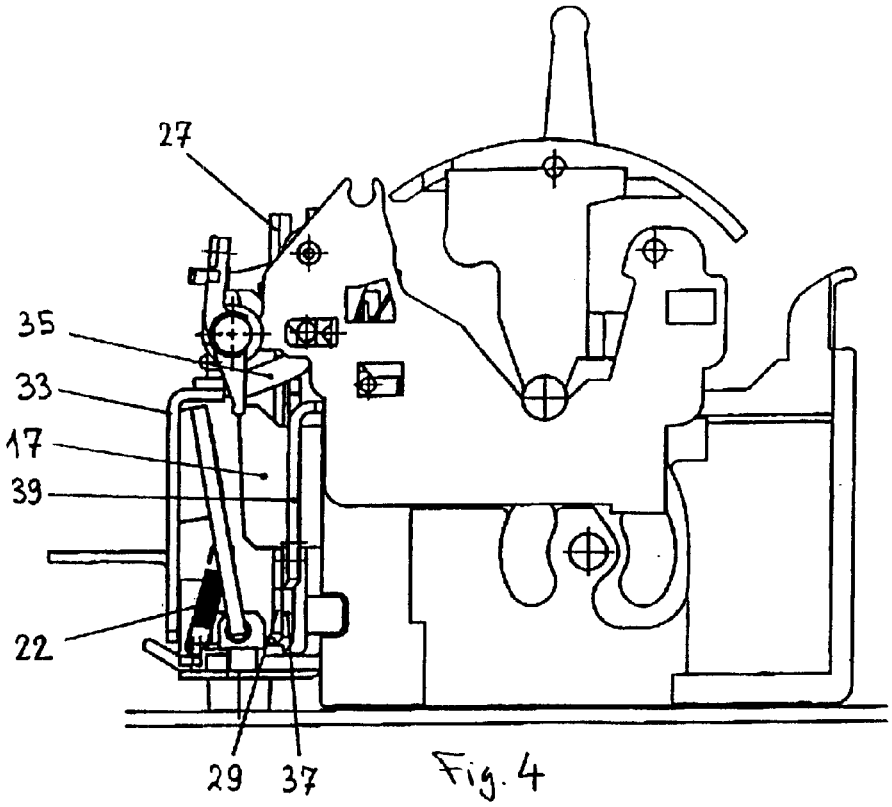
FIG. 4 is a front view of a circuit breaker equipped with an alternate embodiment of the release unit.
Figure 5:
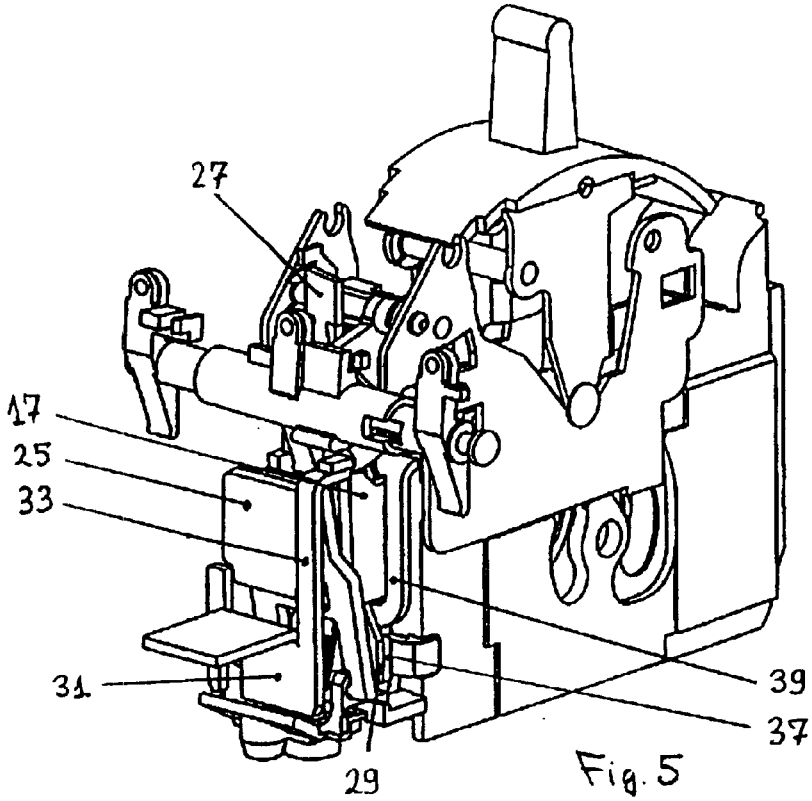
FIG. 5 is a perspective view of the circuit breaker shown in FIG. 4.

The second embodiment of the release unit according to the invention, as shown in FIGS. 4 and 5, differs from the first one in that an external L-shaped part of the rail 19 is designed as a conductor element 31 separated from the rest of the rails, and is connected through a conducting arm 33 and a flexible lead connected to it with the upper section of the bimetallic plate 27. This construction has essentially the same characteristics as the first embodiment, with the additional advantage that as a result of the current flowing through the bimetallic plate 27, direct heating of the latter and thus a response of the release mechanism of the circuit breaker can also be guaranteed with lower overcurrents.

Different variants of the above-mentioned embodiments of a release unit according to the invention are possible; they are defined to some extent in the subclaims. For example, the rails 19 and the conducting element 31 can advantageously be of copper in the second embodiment. It is also advantageous in this second embodiment if the rail 19 does not run simply as a broad strip through the U-shaped magnet yoke, as in the first embodiment, but also runs outside of the magnet yoke.

Although the present invention has been described with reference to certain embodiments, it will be appreciated that these embodiments are not limitations and that the scope of the invention is defined by the following claims.

What is claimed is:

1. A release unit for a circuit breaker comprising:

a fixed magnet yoke;

an armature pivotally coupled relative to said magnet yoke on a first end of said armature for actuating a release device; and a nonmagnetic weight element coupled to said armature on a second end of said armature, said nonmagnetic weight element increasing the inertia of said armature.

2. The release unit of claim 1 wherein said weight element has sufficient weight to prevent disengagement of the circuit breaker at a release current that causes disengagement of a subordinate circuit breaker electrically connected with the circuit breaker.

3. The release unit of claim 2 wherein said weight element has a weight at which the circuit breaker disengages after a 10 msec occurrence of the release current.

4. The release unit of claim 3 wherein said weight element (25) is made from lead.

5. The release unit of claim 4 wherein said magnet yoke is U-shaped and partially surrounds a rail conducting the release current as well as a release element that can be actuated by heating fastened to the rail.

6. The release unit of claim 5 wherein said release element is a bimetallic plate that is connected at its first end section with said rail, while its second end forms a release section.

7. The release unit of claim 6 wherein said bimetallic plate connects two rail sections, said rail sections being insulated electrically from each other and can be actuated by direct heating by current flowing therethrough.

8. The release unit of claim 7 wherein said two rail sections insulated electrically from each other, are of a material whose electrical conductivity is higher than that of said magnet yoke.

9. The release unit of claim 8 wherein said two rail sections insulated electrically from each other, are of a material whose electrical conductivity is higher than that of said bimetallic plate.

10. The release unit of claim 9 wherein said two rail sections, electrically insulated from each other, are made of copper.

11. The release unit of claim 2 wherein said weight element weighs between about 3 grams to about 15 grams.

12. The release unit of claim 2 wherein said weight element weighs between about 9 grams to about 11 grams.

13. The release unit of claim 2 wherein said release current causes said subordinate circuit breaker to disengage within a first half-wave of said release current while said weight element prevents disengagement of the circuit breaker within said first half-wave of said release current.

14. The release unit of claim 2 wherein said release current is less than about fifty times a rated nominal current of the circuit breaker.

* * * * *